US011674412B2

(12) United States Patent
Howard et al.

(10) Patent No.: US 11,674,412 B2
(45) Date of Patent: Jun. 13, 2023

(54) CLOSED LOOP CONTROL EMPLOYING MAGNETOSTRICTIVE SENSING

(71) Applicant: Baker Hughes Holdings LLC, Houston, TX (US)

(72) Inventors: Brian F. Howard, Reno, NV (US); Lysle R. Turnbeaugh, Minden, NV (US); David R. O'Connor, Gardnerville, NV (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 17/713,795

(22) Filed: Apr. 5, 2022

(65) Prior Publication Data

US 2022/0333499 A1 Oct. 20, 2022

Related U.S. Application Data

(60) Provisional application No. 63/175,909, filed on Apr. 16, 2021.

(51) Int. Cl.
*F01D 21/00* (2006.01)
*F01D 21/14* (2006.01)

(52) U.S. Cl.
CPC ..... *F01D 21/003* (2013.01); *F01D 21/14* (2013.01); *F05D 2270/02* (2013.01);
(Continued)

(58) Field of Classification Search
CPC ..... F01D 21/003; F01D 21/14; F04B 49/065; F04D 27/02; F05D 2270/02;
(Continued)

(56) References Cited

U.S. PATENT DOCUMENTS 7,131,339 B2 11/2006 Kwun et al.
7,996,142 B2 8/2011 Sihler et al.
(Continued)

FOREIGN PATENT DOCUMENTS

CN 101169352 B 8/2010
CN 105157968 B 8/2017

OTHER PUBLICATIONS

Lee et al., "Magnetostrictive patch sensor system for battery-less real-time measurement of torsional vibrations of rotating shafts." Journal of Sound and Vibration, vol. 414, pp. 245-258 (2018).

*Primary Examiner* — Audrey B. Walter
*Assistant Examiner* — Dapinder Singh
(74) *Attorney, Agent, or Firm* — Mintz Levin Cohn Ferris Glovsky and Popeo, PC

(57) ABSTRACT

Systems and methods for turbomachine control based upon magnetostrictive sensor measurements are provided. A turbomachine (e.g., a compressor) can be instrumented with at a sensor configured to measure an operating parameter, and a magnetostrictive sensor configured to acquire a torsional measurement (e.g., torsional vibration and/or torque) of a turbomachine shaft. An analyzer can receive the operating parameter measurement and torsional measurement and determine an updated operating parameter limit and/or an updated exclusion zone based upon the torsional measurement for control of the operating parameter.

10 Claims, 4 Drawing Sheets

(52) U.S. Cl.
CPC .. *F05D 2270/304* (2013.01); *F05D 2270/334* (2013.01); *F05D 2270/708* (2013.01)

(58) Field of Classification Search
CPC ..... F05D 2270/304; F05D 2270/334; F05D 2270/708
See application file for complete search history.

(56) References Cited

U.S. PATENT DOCUMENTS

| | | | | |
|---|---|---|---|---|
| 8,465,374 | B2 | 6/2013 | Maier et al. | |
| 11,346,290 | B2 * | 5/2022 | Cai | F02C 3/10 |
| 11,425,200 | B2 * | 8/2022 | Lamberti | G07C 5/0841 |
| 2016/0356266 | A1 | 12/2016 | Koerber et al. | |
| 2018/0245568 | A1 | 8/2018 | Pedersen et al. | |
| 2020/0076596 | A1 * | 3/2020 | Chopart | H04L 9/0891 |
| 2021/0209868 | A1 * | 7/2021 | Scheid | H04L 67/125 |

* cited by examiner

CLOSED LOOP CONTROL EMPLOYING MAGNETOSTRICTIVE SENSING

CROSS-REFERENCE TO RELATED APPLICATIONS

This application claims the benefit of U.S. Provisional Patent Application No. 63/175,909, filed on Apr. 16, 2021, and entitled "Closed Loop Control Employing Magnetostrictive Sensing," the entirety of which is incorporated by reference.

BACKGROUND

Turbomachines are a class of machines that can transfer energy from a rotor to a fluid. Examples can include turbines and compressors, amongst others. It is common for turbomachine operators to theoretically predict the behavior of selected components of the turbomachine (e.g., shafts connected to the rotor) as a function of different operating parameters using one or more models. With a theoretical estimate for the behavior of the selected turbomachine components, operating parameter limits for use during operation of the turbomachine can be identified in order to avoid damage and/or failure.

SUMMARY

One example of turbomachinery behavior is torsional vibration. Torsional vibration refers to oscillatory torsional (twisting) deformations that can occur about the axis of rotating parts, such as shafts in a rotor train. As an example, torsional vibration can arise due to variation in rotational speed within a rotation cycle. By some measures, torsional vibration is one of the leading causes of failure in turbomachinery drive trains. Thus, turbomachinery operators can require torsional studies to be performed, using models to estimate free torsional vibration and forced torsional stress levels at critical components in the rotor to establish operating limits and exclusion zones.

The actual torsional vibration or torque experienced by a turbomachine shaft in service can vary from that estimated from models. As a result, operating parameter limits and corresponding exclusion zones can be set conservatively to avoid excessive torsional vibration and/or torque. However, the use of conservative operating parameter limits and corresponding exclusion zones during operation of a turbomachine can prevent full utilization of its capabilities. Accordingly, it can be desirable to directly measure torsional vibration and/or torque, rather than relying upon model estimates. In this manner, that operating parameter limits can be increased and corresponding exclusion zones can be reduced, maximizing turbomachinery utilization and efficiency.

However, due to sensor limitations in the context of turbomachines, it can be difficult to directly measure torsional vibration and/or torque. In one aspect, encoder-based sensors can measure torsional vibration and/or torque using an encoding mounted on a rotor shaft (e.g., magnetically, optically, etc.) However, mounting an encoding on a rotor shaft can be unfeasible in some turbomachines, for example, due to lack of clearance to accommodate the encoding, inability to retrofit the rotor with the encoding, etc. In another aspect, strain gages can be mounted on the surface of the rotor shaft at ±45° to the rotation axis to measure torsional vibration and/or torque. However, strain gauges require power to operate, which can be difficult to provide in the context of a rotor. Furthermore, strain gauges are typically encapsulated within a polymer and have a limited range of temperature in which they can operate. In further aspects, the environment surrounding a turbomachine rotor can contain oil and other fluids that block or scatter light, preventing the use of optical-based sensors for measurement of torsional vibration and/or torque.

From the forgoing, it can be appreciated that there is an ongoing need for techniques that can directly measure torsional vibration and/or torque occurring within a turbomachine.

Embodiments of the present disclosure provide systems and methods for direct measurement of torsional vibration and/or torque using magnetostrictive sensors and use of these measurements for dynamic adjustment of operating parameter limits and/or exclusion zones of turbomachines in real-time. In general, magnetostriction is a property of ferromagnetic materials that characterizes changes in shape (e.g., expansion or contraction) of the material in the presence of a magnetic field. Conversely, magnetic properties of a ferromagnetic material, such as permeability (the capability to support development of a magnetic field within the material) can change in response to torque applied to the material. A magnetostrictive sensor can generate magnetic flux that permeates a target, such as a shaft, and it can sense the magnetic flux as it interacts with the shaft. As the torque and/or torsional vibration applied to the shaft changes during operation, the magnetostrictive sensor can output signals based upon the sensed magnetic flux that can be used to measure the torque and/or torsional vibration applied to the shaft.

Magnetostrictive sensors provide a number of advantages over other sensors for measurement of torsional vibration and/or torque in the context of turbomachines. In one aspect, magnetostrictive sensors are non-contact sensors and, therefore do not require preparation of the shaft to acquire torsional vibration measurements. This allows magnetostrictive sensors to be used without concern for adherence of the sensor to the shaft, as compared to strain gauges, and without the need for time consuming and costly retrofitting, as compared to encoder-based sensors. In another aspect, because magnetostrictive sensors employ magnetic fields to acquire measurements, they are suitable for operating environments having limited to no visibility, as compared to optical-based sensors. As a result, magnetostrictive sensors can be easily deployed and are suitable for use in a greater variety of turbomachine installations for torsional vibration measurement than other sensors.

In an embodiment, a method of operating a compressor is provided. The method can include receiving, by an analyzer including one or more processors, a measurement of an operating parameter of a compressor during operation. The method can also include receiving, by the analyzer, one or more magnetostrictive signals during the operation of the compressor at the measured operating parameter. The magnetostrictive signals can be received from one or more magnetostrictive sensors in magnetic communication with a shaft of the compressor. The method can further include determining, by the analyzer, a measurement of torsional vibration experienced by the compressor shaft based upon the one or more magnetostrictive signals. The method can additionally include receiving, by the analyzer, at least one of an initial operating limit or an initial exclusion zone for the operating parameter. The method can also include determining, by the analyzer, at least one of an updated operating limit or an updated exclusion zone for the operating parameter based upon the measured torsional vibration. The method can further include outputting at least one of the updated operating limit or updated exclusion zone.

In another embodiment, the updated operating limit or updated exclusion zone can be determined from a lookup table based upon the measured torsional vibration.

In another embodiment, the method can also include maintaining, by a controller including one or more processors in communication with the compressor and the analyzer, at least one of the initial operating limit or the initial exclusion zone for the operating parameter. The method can further include outputting, by the controller, one or more command signals. The command signals can be operative to control the operating parameter to adopt a value less than or equal to the maintained operating limit or to adopt a value outside of the maintained exclusion zone.

In another embodiment, the method can further include receiving, by the controller, at least one of the updated operating limit or the updated exclusion zone. The method can additionally include updating, by the controller, the maintained operating limit or the maintained exclusion zone by replacing the initial operating limit or the initial exclusion zone with the updated operating limit or the updated exclusion zone, respectively.

In another embodiment, a magnitude of the updated operating limit can be greater than a magnitude of the initial operating limit.

In another embodiment, a magnitude of the updated exclusion zone can be less than a magnitude of the initial exclusion zone.

In another embodiment, the one or more operating parameters of the compressor can include at least a rotation speed of the compressor shaft.

In an embodiment, a system for operating a compressor is provided and can include at least one compressor sensor, a magnetostrictive sensor, and an analyzer. The at least one compressor sensor can be configured to output at least one measurement signal including data characterizing an operating parameter of a compressor during operation. The magnetostrictive sensor can be configured to output one or more magnetostrictive signals including data characterizing torsional vibration experienced by a shaft of the compressor during operation. The analyzer can include one or more processors, and it can be configured to receive the at least one measurement signal and determine an operating parameter of a compressor during operation based upon the at least one measurement signal. The analyzer can be further configured to receive the one or more magnetostrictive signals during the operation of the compressor at the measured operating parameter. The analyzer can also be configured to determine a measurement of torsional vibration experienced by the compressor shaft based upon the one or more magnetostrictive signals. The analyzer can additionally be configured to receive at least one of an initial operating limit or an initial exclusion zone for the operating parameter. The analyzer can also be configured to determine at least one of an updated operating limit or an updated exclusion zone for the operating parameter based upon the measured torsional vibration. The analyzer can additionally be configured to output at least one of the updated operating limit or updated exclusion zone.

In another embodiment, the updated operating limit or updated exclusion zone can be determined from a lookup table based upon the measured torsional vibration.

In another embodiment, the system can further include a controller including one or more processors in communication with the analyzer and the compressor. The controller can be further configured to maintain at least one of the initial operating limit or the initial exclusion zone for the operating parameter. The controller can also be configured to output one or more command signals operative to control the operating parameter to adopt a value less than or equal to the maintained operating limit or to adopt a value outside of the maintained exclusion zone.

In another embodiment, the controller can be further configured to receive at least one of the updated operating limit or the updated exclusion zone. The controller can also be configured to update the maintained operating limit or the maintained exclusion zone by replacing the initial operating limit or the initial exclusion zone with the updated operating limit or the updated exclusion zone, respectively.

In another embodiment, a magnitude of the updated operating limit can be greater than a magnitude of the initial operating limit.

In another embodiment, a magnitude of the updated exclusion zone can be less than a magnitude of the initial exclusion zone.

In another embodiment, the one or more operating parameters of the compressor can include at least a rotation speed of the compressor shaft.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Embodiments of systems and corresponding methods for turbomachine control based upon torsional vibration and/or torque measurements acquired using magnetostrictive sensors are discussed herein. Certain embodiments are presented in the context of compressors. However, embodiments of the disclosure can be employed with other turbomachines without limit.

Turbomachines are machines that transfer energy from a rotor to a fluid. A common cause of failure of turbomachines is torsional vibration, oscillating, twisting deformations that can occur about the axis of shaft upon which the rotor is mounted. Torsional vibration can be modeled in order to identify the torsional vibration limit as a function of given operating parameters (e.g., rotor shaft speed). However, the actual torsional vibration can be different from the model. As a result, operating parameter limits can be set conservatively so that the actual torsional vibration does not exceed the torsional vibration limit. Such conservative limits can prevent full utilization of the turbomachine capabilities. While it can be desirable to directly measure torsional vibration, rather than relying upon model estimates, this can be difficult to accomplish as the many sensors can be limited or rendered inoperable when employed in the context of a turbomachine. Embodiments of the present disclosure provide systems and methods for direct measurement of torsional vibration and other torsional parameters (e.g., torque) using magnetostrictive sensors. The direct torsional vibration measurements can be used to adjust the turbomachine operating parameter limits. As compared to operating limits generated based upon models, the adjusted operating limits can be increased and the exclusion zones can be decreased maximizing turbomachine utilization and efficiency.

Figure 1:
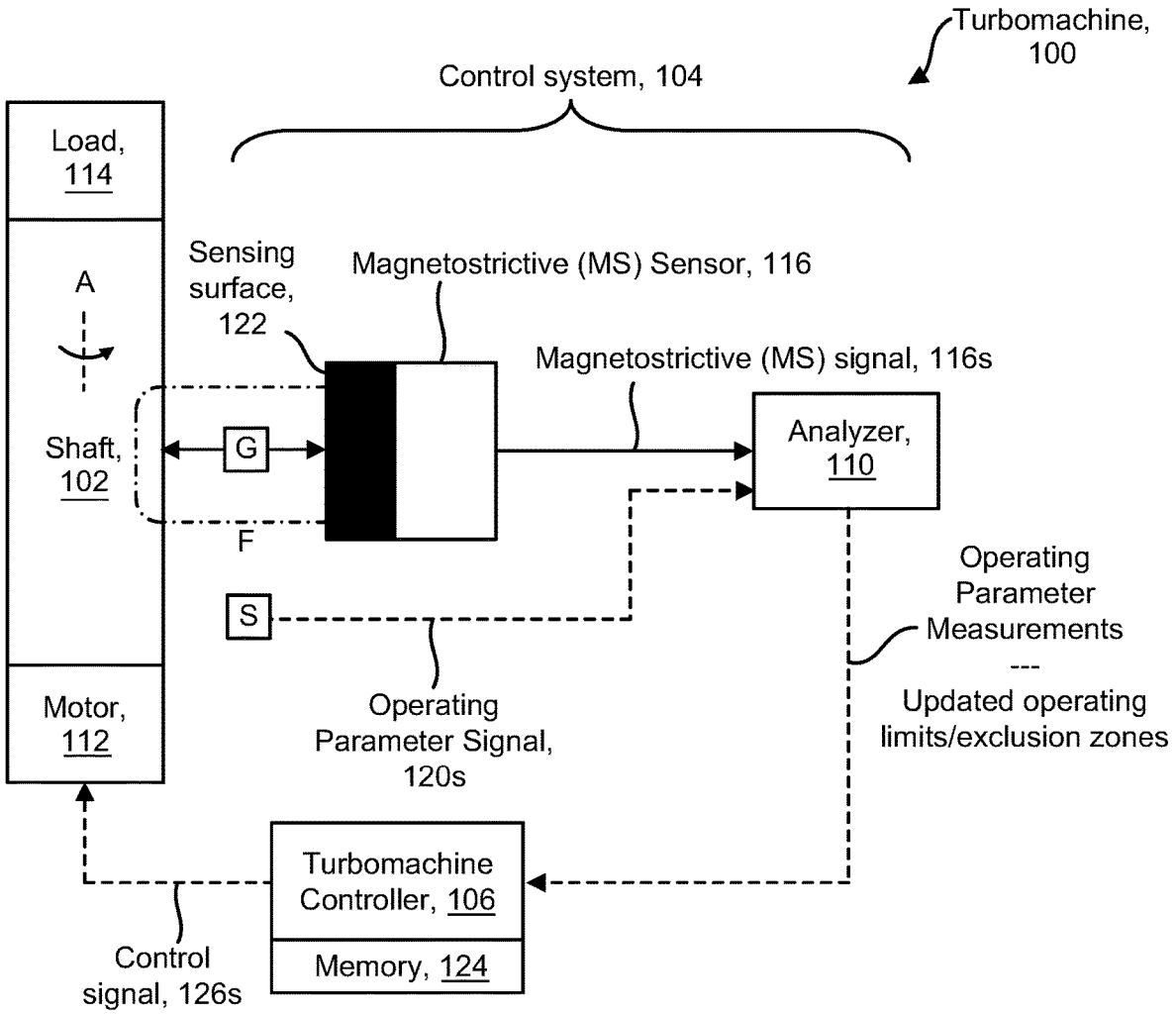
FIG. 1 is a diagram illustrating one exemplary embodiment of turbomachine including a control system configured for closed loop control based upon torsional measurements acquired by magnetostrictive sensors.

FIG. 1 is a diagram illustrating one exemplary embodiment of a turbomachine 100 including a rotatable shaft 102 and a control system 104. The control system 104 can include a turbomachine controller 106, an analyzer 110, and a plurality of sensors. The analyzer 110 can be in communication with the plurality of sensors and the turbomachine controller 106. The turbomachine controller 106 can be communication with one or more devices configured to control respective operating parameters of the turbomachine 100. As an example, the turbomachine controller 106 can be in electrical communication with a motor 112 that is mechanically coupled to the shaft 102 for control of a shaft rotation speed. The shaft 102 can be directly or indirectly coupled to a load 114, such as a rotor of the turbomachine 100 or another shaft (e.g., via a coupling and/or gearbox). While the turbomachine controller 106 and analyzer 110 are illustrated and discussed herein as separate devices, it can be appreciated that, in alternative embodiments, the functionality of each can be performed by a single computing device.

The plurality of sensors can include at least one magnetostrictive sensor 116. The at least one magnetostrictive sensor 116 can be configured to output at least one magnetostrictive signal 116*s* to the analyzer 110. The at least one magnetostrictive signal 116*s* can include data characterizing torsional vibration and/or torque experienced by the shaft 102 during operation of the turbomachine 100. The analyzer 110 can be configured to determine a measurement of the torsional vibration and/or torque experienced by the shaft 102 based upon the received at least one magnetostrictive signal 116*s*.

The plurality of sensors can further include one or more turbomachine sensors S that are in positioned at selected portions of the turbomachine 100. Each of the turbomachine sensors S can be configured to output at least one operating parameter signal 120*s* including data characterizing respective operating parameters of the turbomachine 100 (e.g., shaft rotation speed, axial/radial vibration, fluid temperature, fluid pressure, fluid flow rate, etc.) In certain embodiments, the at least one operating parameter signal 120*s* can contain a measurement of a respective operating parameter. In another embodiment, the analyzer 110 can be configured to determine the measurement of the respective operating parameter based upon the received at least one operating parameter signal 120*s*.

In operation, the at least one magnetostrictive sensor 116 can be positioned adjacent to the shaft 102. As an example, the at least one magnetostrictive sensor 116 can be positioned with a predetermined gap G separating an outer surface of the shaft 102 and a sensing surface 122 of the at least one magnetostrictive sensor 116. As the shaft 102 rotates about an axis A during operation, the at least one magnetostrictive sensor 116 can generate a magnetic flux F that interacts with the shaft 102. The at least one magnetostrictive sensor 116 can be further configured to detect changes in the magnetic flux F resulting from this interaction, and output the at least one magnetostrictive signal 116*s* characterizing the detected changes. The analyzer 110 can receive the at least one magnetostrictive signal 116*s* and determine quantities of interest, including, but not limited to, torsional vibration and torque applied to the shaft 102, based upon the at least one magnetostrictive signal 116*s*.

The analyzer 110 can be further configured to receive the at least one operating parameter signal 120*s* from the other turbomachine sensors S and to determine respective operating parameters of the turbomachine 100 based upon the received at least one operating parameter signal 120*s*. The measured operating parameters can be output to the turbomachine controller 106.

In general, the turbomachine controller 106 can further maintain (e.g., in a memory 124) operating limits and exclusion zones for respective operating parameters of the turbomachine 100. An operating limit can represent a maximum or minimum allowed value for an operating parameter during operation of the turbomachine 100. An exclusion zone can represent a range of values for an operating parameter values that are prohibited during operation of the turbomachine 100. The range can be continuous or discontinuous. The operating limits and exclusion zones can be selected to ensure that the torsional vibration and/or torque of the turbomachine 100 does not exceed respective predetermined limits. Accordingly, the turbomachine controller 106 can receive the measured operating parameter from the analyzer 110 and output at least one control signal 126*s* to the respective control devices (e.g., motor 112) that control respective operating parameters of the turbomachine 100 to remain within the maintained operating limits and/or exclusion zones.

The analyzer 110 can be further configured to update these operating limits and/or exclusion zones for one or more of the operating parameters based upon the actual torsional vibration and/or torque measurements acquired by the at least one magnetostrictive sensor 116. In one example, the analyzer can maintain a lookup table that lists torsional vibration and/or torque along with corresponding operating limits and/or exclusion zones for respective operating parameters. In another example, the analyzer can execute an algorithm that outputs updated operating limits and/or exclusion zones for one or more of the operating parameters based upon the measured torsional vibration and/or torque. In alternative embodiments, other techniques for updating the operating limits and/or exclusion zones for one or more of the operating parameters based upon the actual torsional vibration measurements can be employed without limit.

Beneficially, the updated operating limits can be increased and/or the updated exclusion zones can be reduced, as compared to those determined from model predictions of the torsional vibration, allowing greater utilization and efficiency of the turbomachine 100.

Figure 2:
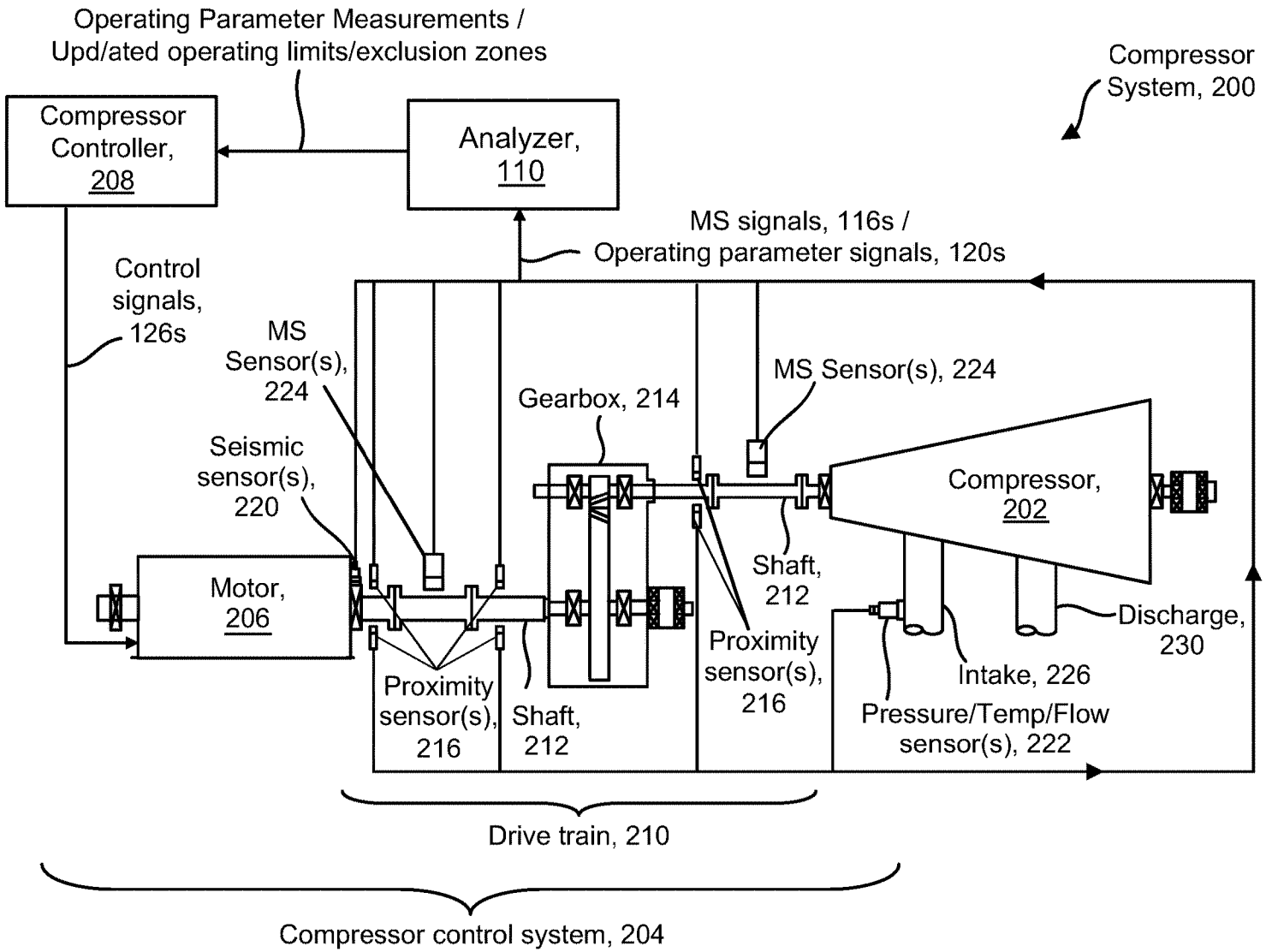
FIG. 2 is a diagram illustrating one exemplary embodiment of the turbomachine of FIG. 1 in the form of a compressor system.

Embodiments of the turbomachine 100 can adopt a variety of configurations. FIG. 2 is a schematic block diagram illustrating one exemplary embodiment of the turbomachine 100 of FIG. 1 in the form of a compressor system 200 having a compressor 202 in communication with the control system 104. The compressor system 200 can further include a motor 206 in mechanical communication with the compressor 202 via a drive drain 210. As shown, the drive train 210 can include a plurality of shafts 212 coupled together by a gearbox 214. However, in alternative embodiments, the number of shafts and the manner in which they are coupled can be varied, as necessary.

As discussed in above, the control system 104 can include the turbomachine controller 106 (now referred to as compressor controller 208), the analyzer 110, and the plurality of sensors. Examples of the plurality of sensors can include, but are not limited to, one or more of speed sensors, proximity sensors 216, seismic sensors 220, pressure/temperature/flow sensors 222, or magnetostrictive sensors 224.

The speed sensors (not shown) can be configured to measure the speed of respective shafts 212 and direction of rotation. In an embodiment, one or more speed sensors can be mounted to a motor shaft. Examples of speed sensors can include, but are not limited to, Hall Effect magnetic speed sensors, inductive speed sensors, and variable reluctance magnetic speed sensors.

The proximity sensors 216 are sensors that can be configured to measure the approach or presence of nearby objects. Embodiments of the proximity sensors 216 can adopt a variety of forms, including but not limited to, capacitive proximity sensors, ultrasonic proximity sensors, infrared proximity sensors, photoelectric proximity sensors, magnetic proximity sensors, and LIDAR proximity sensors. In the context of the compressor system 200, the proximity sensors 216 can be employed to measure variation in distance between a shaft and its support bearing. As an example, the proximity sensors 216 can be beneficial for detection of runout, where the shaft does not rotate in-line with its axis, which can cause vibration and increased loads on the bearings.

The seismic sensors 220 are sensors that can be configured to measure absolute vibrations of selected components of the compressor system (e.g., casing vibration). In certain embodiments, the seismic sensors 220 can include accelerometers. The seismic sensors 220 can be of particular benefit in harsh environments where other position and/or velocity sensors are not useable (e.g., in high temperature areas).

The plurality of sensors can be deployed at selected locations within the compressor system 200 for acquiring respective operating parameter measurements and torsional vibration measurements. For example, pressure, temperature, and flow sensors 222 can be positioned at an intake 226 of the compressor 202, a discharge 230 of the compressor 202, or both for measurement of fluid pressure, fluid temperature, and fluid flow rate, respectively.

Under circumstances where multiple shafts are present, selected ones of the plurality of sensors (e.g., the seismic sensors 220, the proximity sensors 216, the at least one magnetostrictive sensors 224, etc.) can be positioned to acquire respective measurements related to one shaft, a portion of the shafts, and all shafts, as desired.

Figure 3:
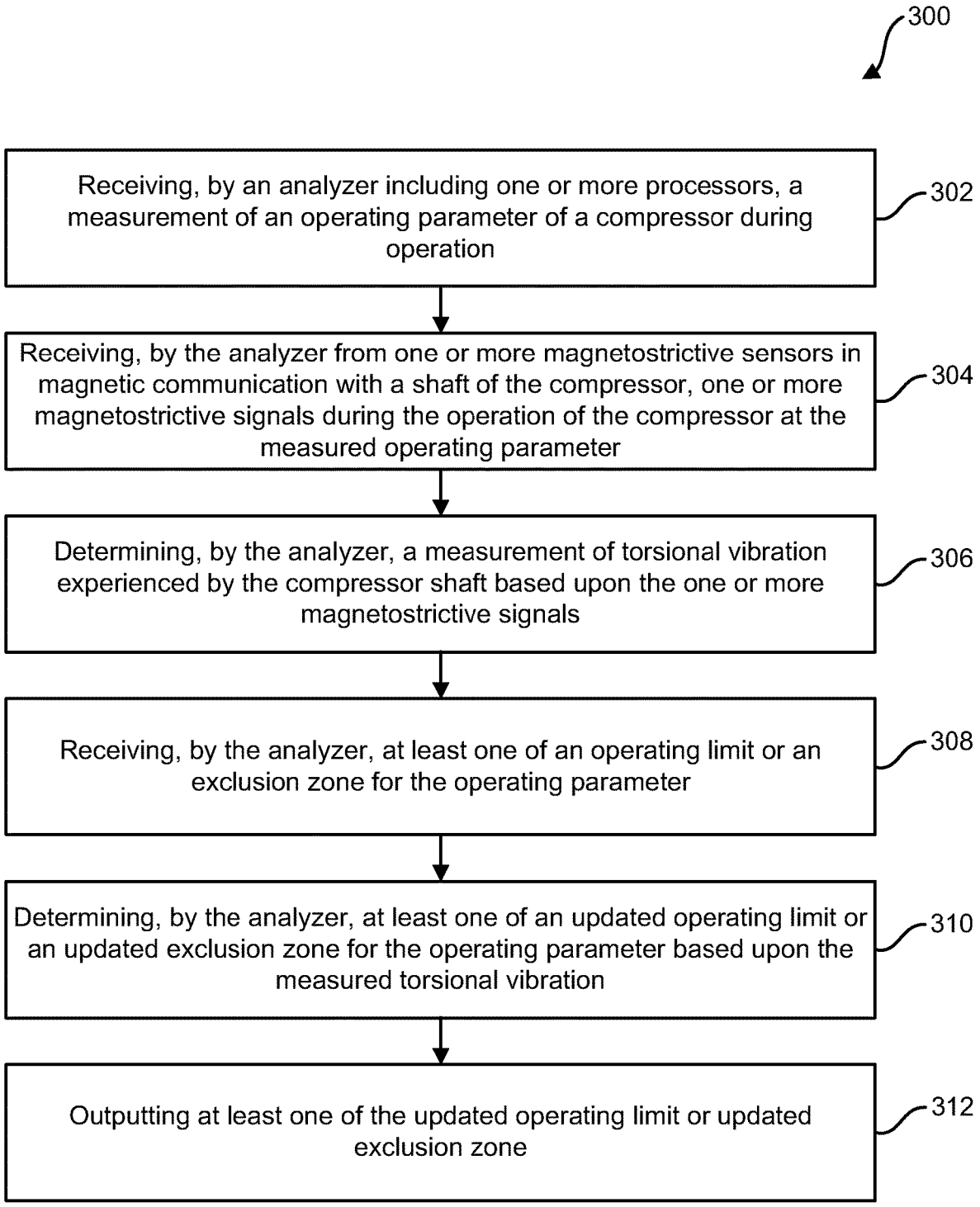
FIG. 3 is a flow diagram illustrating one exemplary embodiment of a method for control of the turbomachine of FIG. 1 based upon torsional measurements.

FIG. 3 is a flow diagram illustrating one exemplary embodiment of a method 300 for operating a turbomachine, such as a compressor, using measurements of torsional vibration and/or torque acquired by a magnetostrictive sensor. As shown, the method includes operations 302-314. However, it can be understood that alternative embodiments of the method can include greater or fewer operations than illustrated in FIG. 3 and the operations can be performed in a different order than illustrated in FIG. 3.

In operation 302, a measurement of an operating parameter of a compressor (e.g., the compressor 202) during operation is received by an analyzer (e.g., by one or more processors of the analyzer 110). As an example, the operating parameter measurement can be contained within the at least one operating parameter signal 120*s* received from the turbomachine sensors S or determined from the at least one operating parameter signal 120*s*.

In operation 304, the analyzer 110 can receive the at least one magnetostrictive signal 116*s* during the operation of the compressor 202 at the measured operating parameter. The at least one magnetostrictive signal 116*s* can be acquired by a magnetostrictive sensor (e.g., magnetostrictive sensor(s) 116/224) in magnetic communication with a shaft (e.g., shaft(s) 212) of the compressor 202 and transmitted to the analyzer 110.

In operation 306, the analyzer 110 can determine a measurement of torsional vibration experienced by the compressor shaft based upon the received at least one magnetostrictive signal 116*s*.

In operation 310, at least one of an initial operating limit or an initial exclusion zone for the operating parameter can be received by the analyzer 110. In one embodiment, the initial operating limit or the initial exclusion zone can be received from the compressor controller 208. In another embodiment, the initial operating limit or the initial exclusion zone can be received from another electronic storage device or from operator input.

In operation 312, the analyzer 110 can determine at least one of an updated operating limit or an updated exclusion zone for the operating parameter based upon the measured torsional vibration. In an embodiment, the updated operating limit or the updated exclusion zone can be determined from a lookup table based upon the measured torsional vibration. The updated operating limit or updated exclusion zone can be different from the initial operating limit or the initial exclusion zone.

In operation 314, the analyzer 110 can output at least one of the updated operating limit or updated exclusion zone. As an example, the analyzer 110 can output the updated operating limit or updated exclusion zone to the compressor controller 208.

The compressor controller 208 can be in communication with the compressor 202 (e.g., the motor 206) and the analyzer 110. The compressor controller 208 can maintain at least one of an initial operating limit or an initial exclusion zone for the operating parameter (e.g., within a memory). The compressor controller 208 can further be configured to output one or more at least one control signal 126*s*. The at least one control signal 126*s* can be operative to control the operating parameter of the compressor 202 to adopt a value that satisfies the maintained operating limit or the maintained exclusion zone corresponding to the operating parameter. In one example, the at least one control signal 126*s* can command the motor 206 to cause the operating parameter to adopt a value that is less than or equal to the maintained operating limit. In another example, the at least one control signal 126*s* can control the operating parameter to adopt a value that is outside of the maintained exclusion zone.

The compressor controller 208 can also be configured to receive at least one of the updated operating limit or the updated exclusion zone and update the maintained operating limit or the maintained exclusion zone from the analyzer 110. As an example, the initial operating limit or the initial exclusion zone can be replaced with the updated operating limit or the updated exclusion zone, respectively. The at least one control signal 126*s* can be operative to control the operating parameter of the compressor 202 to adopt a value that satisfies the updated operating limit or the updated exclusion zone corresponding to the operating parameter. In one example, the at least one control signal 126*s* can command the motor 206 to cause the operating parameter to adopt a value that is less than or equal to the updated operating limit. In another example, the at least one control signal 126*s* can control the operating parameter to adopt a value that is outside of the updated exclusion zone.

In another embodiment, systems and methods are provided to detect and control the occurrence of surge within a dynamic compressor. In general, performance of a compressor can be characterized by the change in pressure at the compressor discharge as the inlet flow is varied for a given operating parameter, such as speed. During surge, the pressure developed by the compressor can be less than the pressure on the discharge side of the compressor. As a result, forward fluid flow through the compressor can stop and reverse direction (e.g., from a discharge side towards an intake side). This reverse flow decreases the pressure on the discharge side. When the pressure on the discharge side falls below the pressure developed by the compressor, forward fluid flow starts again. If the pressure on the discharge side subsequently increases, this surge cycle can repeat.

Full reversal of flow occurs during relatively severe (violent) instances of surge. Alternatively, instances of relatively less severe (mild) surge can also occur when there is a fluid flow instability without full flow reversal. In this context, stability can mean that a finite flow fluctuation is not amplified by the compressor. That is, a small reduction in flow results in an increase in the discharge pressure, counteracting the disturbance. In contrast, instability can mean that a finite flow fluctuation is amplified by the compressor (e.g., a small reduction in flow results in a decrease in the discharge pressure and amplification of the flow reduction).

It can be desirable to avoid severe surge, as the intermittent nature of the flow reversal can create large forces capable of damaging compressor components (e.g., bearings, seals, other rotating elements, etc.) While techniques have been developed to detect surge, they rely upon measurement of compressor operating parameters that are indirectly affected by surge, such as fluid pressure, fluid temperature, and/or fluid flow). Such techniques can be less accurate for detection of surge than those which employ direct measurements.

Embodiments of the present disclosure are further provided that employ direct measurements to detect compressor surge. Surge can act to change the torque of a compressor shaft. By measuring changes in torque associated with flow changes, surge can be directly detected. Control systems can be further employed to inhibit and/or substantially eliminate surge based upon such surge detection.

Figure 4:
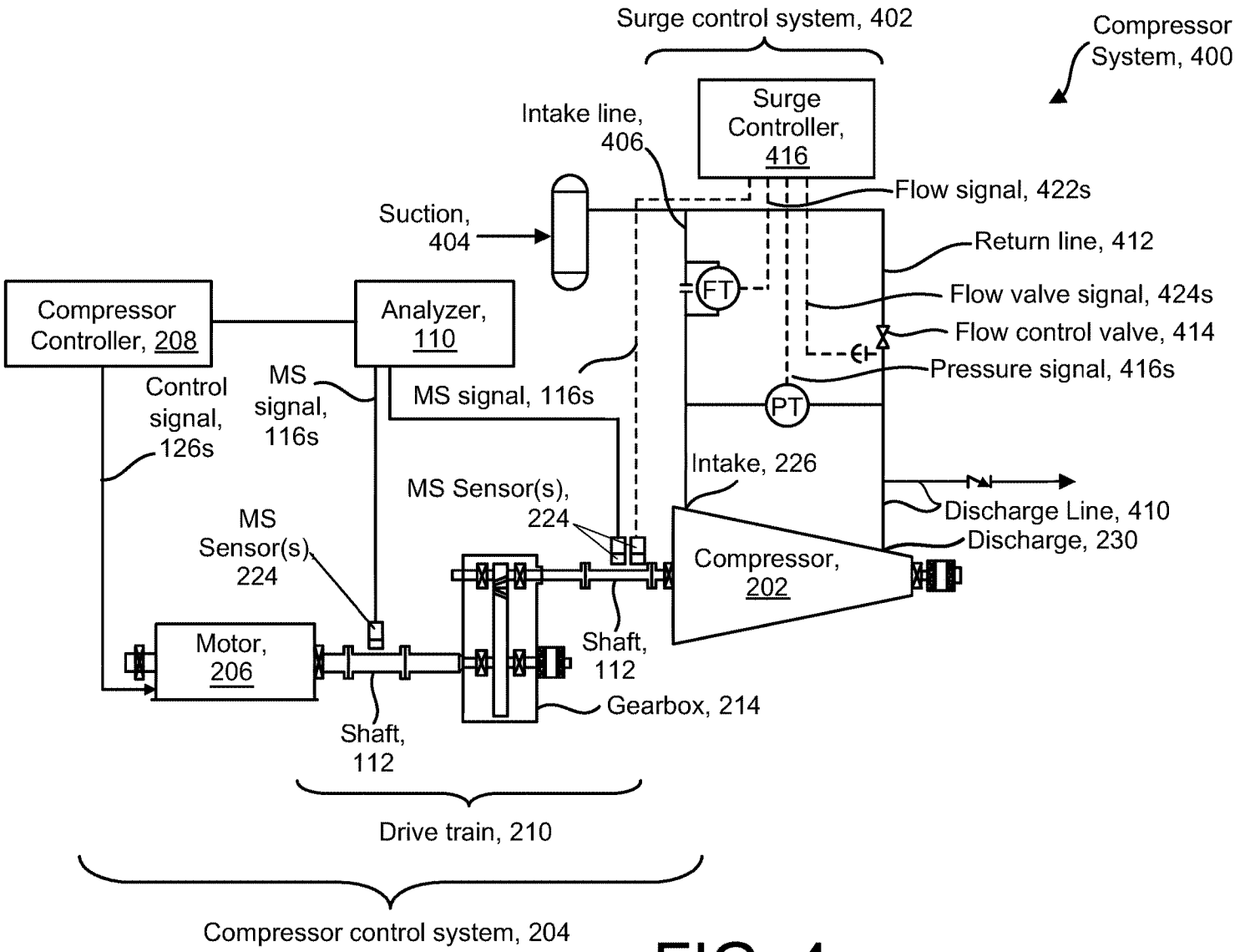
FIG. 4 is a diagram illustrating an exemplary embodiment of another turbomachine in the form of a compressor system including a surge control system configured to detect and suppress surge based upon torsional measurements acquired by magnetostrictive sensors.

FIG. 4 is a block diagram illustrating an exemplary embodiment of a compressor system 400 configured for surge detection and control. The compressor system 400 of FIG. 4 can be similar to the compressor system 200 of FIG. 2, including the compressor 202 and the compressor control system 204, with the addition of a surge control system 402.

As shown, the compressor 202 is in mechanical communication with the motor 206 via the plurality of shafts 212 and the gearbox 214. However, it can be understood that in alternative embodiments, the gearbox can be omitted and the motor can be directly connected to the compressor rotor via a single shaft. The intake 226 of the compressor 202 is in fluid communication with a suction 404 via an intake line 406 and the discharge 230 of the compressor 202 can be in fluid communication with a discharge line 410. A return line 412 can be further provided downstream from the discharge 230 and in fluid communication with the intake line 406. A flow control valve 414 can be positioned within the return line 412 to control flow of fluid between the discharge line 410 and the intake line 406.

The surge control system 402 can include a surge controller 416, the plurality of sensors, and the flow control valve 414. The at least one magnetostrictive sensor 224 can be in communication with the surge controller 416 and configured to output the at least one magnetostrictive signal 116*s* to the surge controller 416. Similar to the analyzer 110, the surge controller 416 can be configured to determine a measurement torsional vibration and/or torque experienced by the compressor shaft based upon the at least one magnetostrictive signal 116*s*.

The at least one magnetostrictive sensor 224 can be positioned adjacent to a shaft for measurement of torsional vibration and/or torque. As shown, the at least one magnetostrictive sensor 224 is positioned adjacent to each shaft 212 connecting the motor 206 to the compressor 202. However, greater or fewer magnetostrictive sensors can be employed as needed.

The surge controller 416 can also be in communication with at least a portion of the plurality of turbomachine sensors S. As discussed above, the plurality of turbomachine sensors S can include flow sensors, temperature sensors, pressure sensors, and the like. As an example, a flow sensor (FT) can be in fluid communication with the intake line 406 for measurement of a fluid flow to the intake side of the compressor 202 (e.g., volumetric flow rate, mass flow rate, etc.) A pressure sensor (PT) can be in fluid communication with the intake line 406 and the discharge line 410 of the compressor 202 for measuring a pressure differential therebetween. Additionally or alternatively, a plurality of pressure sensors can be provided in fluid communication with each of the intake line 406 and discharge line 410 for independent measurement of the intake pressure and the discharge pressure. Each of the plurality of turbomachine sensors S can be configured to provide at least one measurement signal (e.g., a temperature signal (not shown), a pressure signal (Press. signal 420*s*), a flow signal 422*s*) including data characterizing a respective operating parameter of the compressor (e.g., fluid pressure, fluid temperature, fluid flow rate, etc.) to the surge controller 416.

The surge controller 416 can be further configured to identify the presence or absence of compressor surge based upon measurements of torque changes associated with flow changes. During surge, the flow separates from the rotor (impeller) and reverses. As the flow separates, the torque magnitude will begin to change (decrease). This change continues until the flow drops to about zero when the torque magnitude is low. As the flow recovers, the torque rises and the surge cycle repeats.

As discussed above, the surge controller 416 can determine the torque and corresponding flow from the magnetostrictive sensor(s) 224 and the flow sensor (FT) in real-time. The surge controller 416 can be further configured to detect the occurrence of surge based upon analysis of the changes in torque associated with flow changes.

The surge controller 416 can be further configured to control surge (e.g. reduce or substantially eliminate) after detection. Surge occurs when the discharge pressure exceeds the pressure within the compressor 202. Thus, surge can be inhibited by reducing the discharge pressure. Accordingly, upon detection of surge, the surge controller can generate and transmit commands the flow control valve 414 (e.g., via at least one flow valve signal 424*s*) operative to cause the flow control valve 414 to open in order to direct flow from the discharge line 410 to the intake line 406 and reduce the discharge pressure. Further commands operative to cause the flow control valve 414 to close can also be generated and transmitted as necessary.

Exemplary technical effects of the methods, systems, and devices described herein include, by way of non-limiting example adjustment of operating limits and/or exclusion zones based upon measurements torsional parameters of a turbomachine shaft, such as torsional vibration and torque. In contrast to operating limits and exclusion zones generated based upon models of the torsional parameters, the adjusted operating limits can be increased and the exclusion zones can be decreased. In this manner, turbomachine utilization and efficiency can be maximized.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

The subject matter described herein can be implemented in analog electronic circuitry, digital electronic circuitry, and/or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having a display device, e.g., a CRT (cathode ray tube) or LCD (liquid crystal display) monitor, for displaying information to the user and a keyboard and a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor and network interface). The modules described herein can be combined, integrated, separated, and/or duplicated to support various applications. Also, a function described herein as being performed at a particular module can be performed at one or more other modules and/or by one or more other devices instead of or in addition to the function performed at the particular module. Further, the modules can be implemented across multiple devices and/or other components local or remote to one another. Additionally, the modules can be moved from one device and added to another device, and/or can be included in both devices.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A method of operating a compressor, comprising:

receiving, by an analyzer including one or more processors, a measurement of an operating parameter of a compressor during operation;

receiving, by the analyzer from one or more magnetostrictive sensors in magnetic communication with a shaft of the compressor, one or more magnetostrictive signals during the operation of the compressor at the measured operating parameter;

determining, by the analyzer, a measurement of torsional vibration experienced by the compressor shaft based upon the one or more magnetostrictive signals;

receiving, by the analyzer, at least one initial operating range marked by an initial maximum value for the operating parameter and an initial minimum value for the operating parameter during operation;

determining, by the analyzer, that the measured operating parameter is within the at least one initial operating range;

determining, by the analyzer, at least one updated operating range including an updated maximum value for the operating parameter and an updated minimum value for the operating parameter during operation based upon the measured torsional vibration, wherein the updated maximum value is greater than the initial maximum value and/or the updated minimum value is less than the initial minimum value; and outputting the at least one updated operating range.

2. The method of claim 1, wherein the updated operating range is determined from a lookup table based upon the measured torsional vibration.

3. The method of claim 1, further comprising:

maintaining, by a controller including one or more processors in communication with the compressor and the analyzer, the at least one initial operating range; and outputting, by the controller, one or more command signals operative to control the operating parameter to adopt the updated maximum value and/or the updated minimum value.

4. The method of claim 3, further comprising:

receiving, by the controller, the at least one updated operating range; and updating, by the controller, the maintained operating range by replacing the at least one initial operating range with the at least one updated operating range.

5. The method of claim 1, wherein the operating parameter of the compressor comprises at least a rotation speed of the compressor shaft.

6. A system for operating a compressor, comprising:

at least one compressor sensor configured to output at least one measurement signal including data characterizing an operating parameter of a compressor during operation;

at least one magnetostrictive sensor configured to output one or more magnetostrictive signals including data characterizing torsional vibration experienced by a shaft of the compressor during operation; and an analyzer including one or more processors configured to:

receive the at least one measurement signal and determine an operating parameter of a compressor during operation based upon the at least one measurement signal;

receive the one or more magnetostrictive signals during the operation of the compressor at the measured operating parameter;

determine a measurement of torsional vibration experienced by the compressor shaft based upon the one or more magnetostrictive signals;

receive at least one initial operating range marked by an initial maximum value for the operating parameter and an initial minimum value for the operating parameter during operation;

determine that the measured operating parameter is within the at least one initial operating range;

determine at least one updated operating range including an updated maximum value for the operating parameter and an updated minimum value for the operating parameter during operation based upon the measured torsional vibration, wherein the updated maximum value is greater than the initial maximum value and/or the updated minimum value is less than the initial minimum value; and output the at least one updated operating range.

7. The system of claim 6, wherein the updated operating range is determined from a lookup table based upon the measured torsional vibration.

8. The system of claim 6, further comprising a controller including one or more processors in communication with the compressor and the analyzer, wherein the controller is configured to:

maintain the at least one initial operating range; and output one or more command signals operative to control the operating parameter to adopt the updated maximum value and/or the updated minimum value.

9. The system of claim 8, wherein the controller is further configured to:

receive the at least one updated operating range; and update the maintained operating range by replacing the at least one initial operating range with the at least one updated operating range.

10. The system of claim 6, wherein the operating parameter of the compressor comprises at least a rotation speed of the compressor shaft.

* * * * *